US007026903B2

(12) United States Patent
Hsu et al.

(10) Patent No.: US 7,026,903 B2
(45) Date of Patent: Apr. 11, 2006

(54) FILTERING INDUCTION DEVICE

(75) Inventors: Han-Cheng Hsu, Taoyuan Hsien (TW); Wen-Te Ko, Taoyuan Hsien (TW)

(73) Assignee: Delta Electronics Inc., Taoyuan Sien (TW)

( * ) Notice: Subject to any disclaimer, the term of this patent is extended or adjusted under 35 U.S.C. 154(b) by 41 days.

(21) Appl. No.: 10/735,097

(22) Filed: Dec. 12, 2003

(65) Prior Publication Data

US 2004/0124950 A1 Jul. 1, 2004

Related U.S. Application Data

(62) Division of application No. 10/127,288, filed on Apr. 22, 2002, now Pat. No. 6,707,366.

(30) Foreign Application Priority Data

Apr. 30, 2001 (TW) ..... 90206873 U

(51) Int. Cl.
*H01F 5/00* (2006.01)

(52) U.S. Cl. ..... 336/200

(58) Field of Classification Search ..... 336/65, 336/83, 200, 206–208, 232
See application file for complete search history.

(56) References Cited

U.S. PATENT DOCUMENTS

| | | | | |
|---|---|---|---|---|
| 5,084,958 | A * | 2/1992 | Yerman et al. | 29/606 |
| 5,126,715 | A * | 6/1992 | Yerman et al. | 336/183 |
| 5,331,536 | A * | 7/1994 | Lane | 363/126 |
| 5,521,573 | A * | 5/1996 | Inoh et al. | 336/180 |
| 6,087,922 | A * | 7/2000 | Smith | 336/223 |
| 6,420,953 | B1 * | 7/2002 | Dadafshar | 336/200 |
| 6,831,544 | B1 * | 12/2004 | Patel et al. | 336/200 |

* cited by examiner

*Primary Examiner*—Tuyen T Nguyen
(74) *Attorney, Agent, or Firm*—Thomas, Kayden, Horstemeyer & Risley

(57) ABSTRACT

A filtering induction device is provided to improve the filter effect via the increase of an insertion loss resulting from stray capacitance. The induction device includes at least one core structure, and first and second flat coils that interlacing with each other. The first flat coil is used as an inductor, and the second flat coil is used as an electrode belonging to a capacitor formed between the circles of the first flat coil.

11 Claims, 7 Drawing Sheets

FILTERING INDUCTION DEVICE

CROSS-REFERENCE TO RELATED APPLICATIONS

This application is a division of U.S. patent application Ser. No. 10/127,288, filed on Apr. 22, 2002.

BACKGROUND OF THE INVENTION

1. Field of the Invention

The present invention relates to an induction device, particularly to a high-efficiency induction device.

2. Description of the Prior Art

It is well known that an inductor may be applied to form a low-pass filter, and that the efficiency of the low-pass filter may be further improved by means of increasing the insertion loss resulting from the application of an additional capacitor.

In traditional technology, the combination of inductors and capacitors are realized by serially connecting one terminal of a substantial capacitor, i.e. a ceramic capacitor, to two inductors, thereby forming a three-terminal low-pass filter. As shown in FIG. 1(*a*), a traditional low-pass filter is comprised of a ceramic capacitor 10, two inductors 20, and three terminals 31, 32, 33. The two inductors are connected to one terminal of the ceramic capacitor 10, thereby forming the equivalent circuit shown in FIG. 1(*b*). This structure has the disadvantage of high cost and large volume and may not be fabricated to be a surface-mounted type (SMT) device.

Therefore, a SMT low-pass filter with low production cost is required in the industry.

SUMMARY OF THE INVENTION

The purpose of the present invention is to provide a filtering induction device.

The induction device provides an improved filter effect via the increase of an insertion loss resulting from stray capacitance. The induction device is comprised of a core structure, and first and second flat coils that interlacing with each other. The first flat coil is used as an inductor, and the second flat coil is used as an electrode board that belongs to a capacitor formed between the circles of the first flat coil.

The filtering induction device of the present invention is comprised of a core structure and two flat coils, a first flat coil and a second flat coil. The first flat coil is formed by winding a first conductive strip to form a spiral comprising at least one circle. The cross-section of the first conductive strip is a rectangle, and the first conductive strip is comprised of a first upper surface and a first lower surface. The circles each have the same first radius and are arranged layer by layer, wherein the first conductive strip is covered with an isolation material, such that the first flat coil is used as an inductor.

The structure of the second flat coil is similar to that of the first flat coil. The second flat coil is formed by winding a second conductive strip to form a spiral comprising at least one circle. The shape of the cross-section of the second conductive strip is a rectangle, and the second conductive strip is comprised of a second upper surface and a second lower surface. Particularly, the circles each have the same second radius and are arranged layer by layer, wherein the second conductive strip is covered with an isolation material or dielectric material. In this embodiment, the first and second radius may or may not equal.

According to theories about plate capacitors, because of the coverage of the isolation or dielectric material, the stray capacitance will be formed between the first upper surface and the first lower surface. Two capacitors can be formed by inserting an electrode board between these two surfaces. In this invention, the second flat coil is used to provide a plurality of equivalent electrode boards.

In the present invention, each circle of the second flat coil is inserted between opposite sections of the first upper surface and the first lower surface, such that the second upper surface is opposite to the first lower surface and the second lower surface is opposite to the first upper surface. In operation, the second flat coil is grounded with a terminal. Because the shapes of the first and second flat coils are both spirals, interlacing the two flat coils together would effectively compose a low-pass filter.

The coil assembly composed of the first and second flat coils is disposed in a core structure. The core structure, for example, is comprised of a core base and a core cover. By forming the core cover on the core base containing the coil assembly, the fabrication of the low-pass filter of the present invention is completed.

A BRIEF DESCRIPTION OF THE DRAWINGS

FIG. 1(*b*) shows a circuit diagram of the traditional low-pass filter shown in FIG. 1(*a*);

FIG. 2(*b*) shows a cross-section of the flat coil according to the present invention;

FIG. 3(*b*) shows a circuit diagram of the low-pass filter according to the present invention;

FIG. 3(*c*) shows an exploded view of the low-pass filter according to the present invention.

DETAIL DESCRIPTION OF THE EMBODIMENTS

The induction device according to the present invention has the improved effect of low-pass filter via the increase of an insertion loss resulting from stray capacitance. Furthermore, the induction device of the present invention is a thin surface-mounted device (SMD).

Figure 1B:
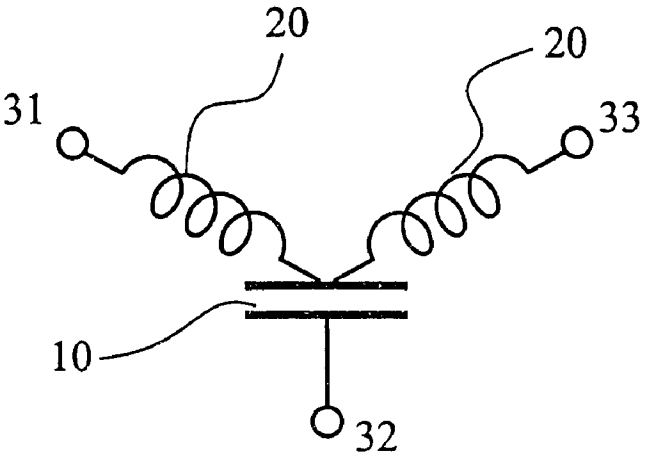
FIG. 1b (PRIOR ART)
FIG. 1(*a*) shows a traditional low-pass filter.
Figure 1A:
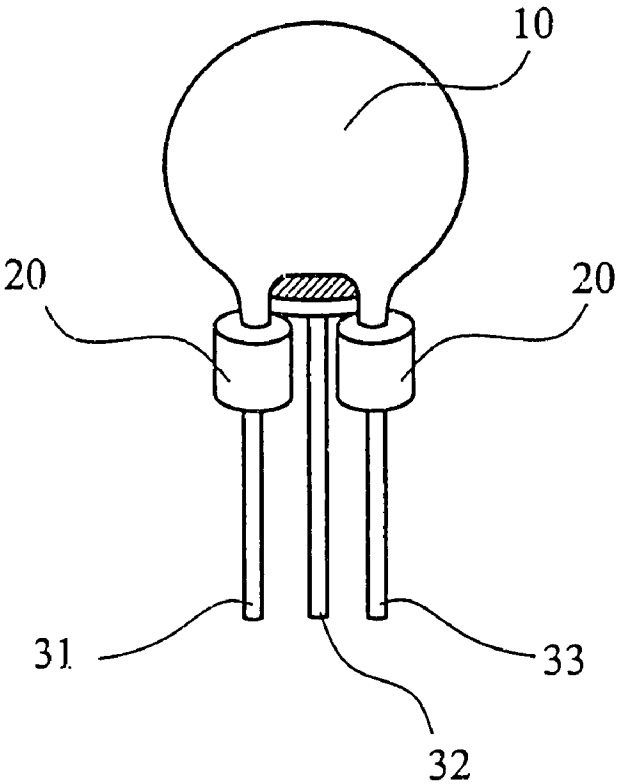
FIG. 1a (PRIOR ART)
Figure 2A:
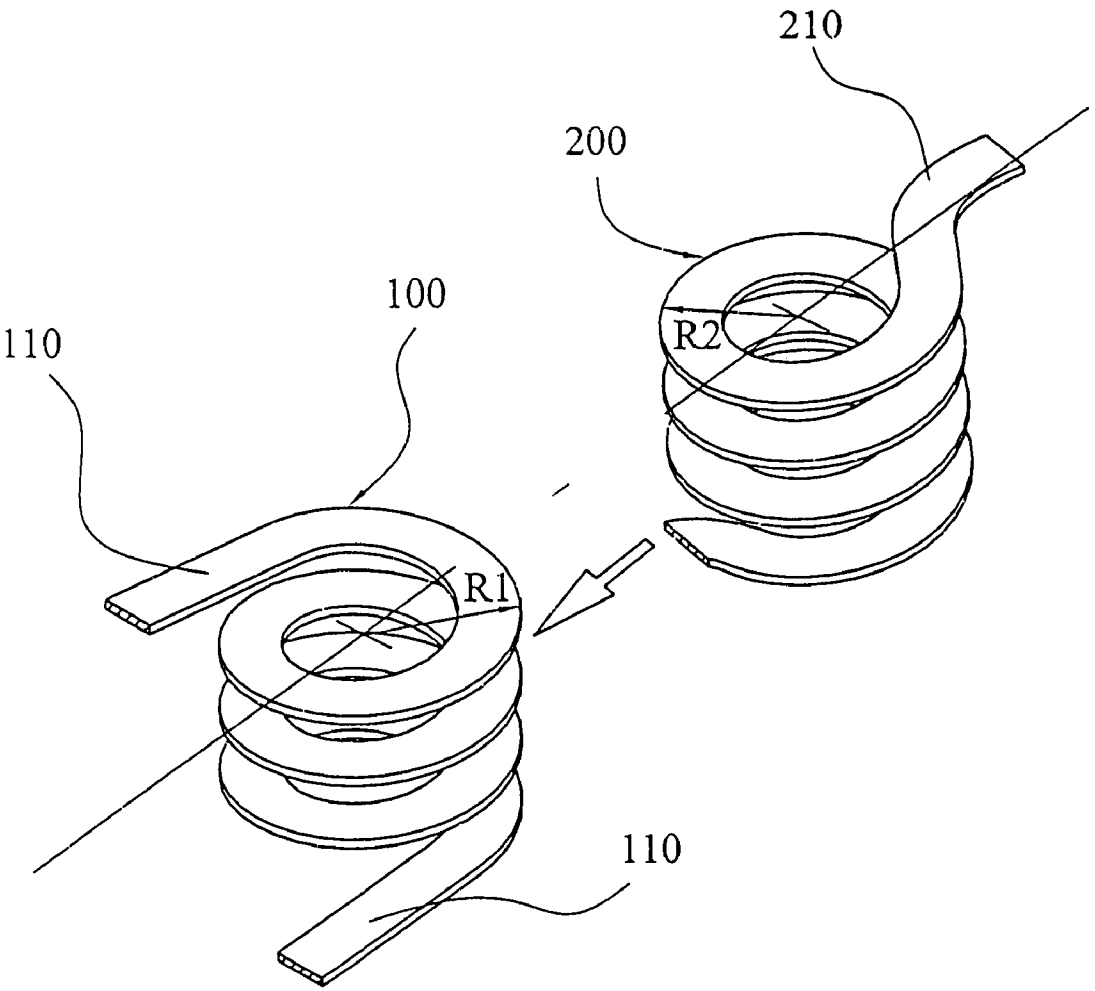
FIG. 2(*a*) shows an exploded view of a low-pass filter according to the present invention.
Figure 2B:
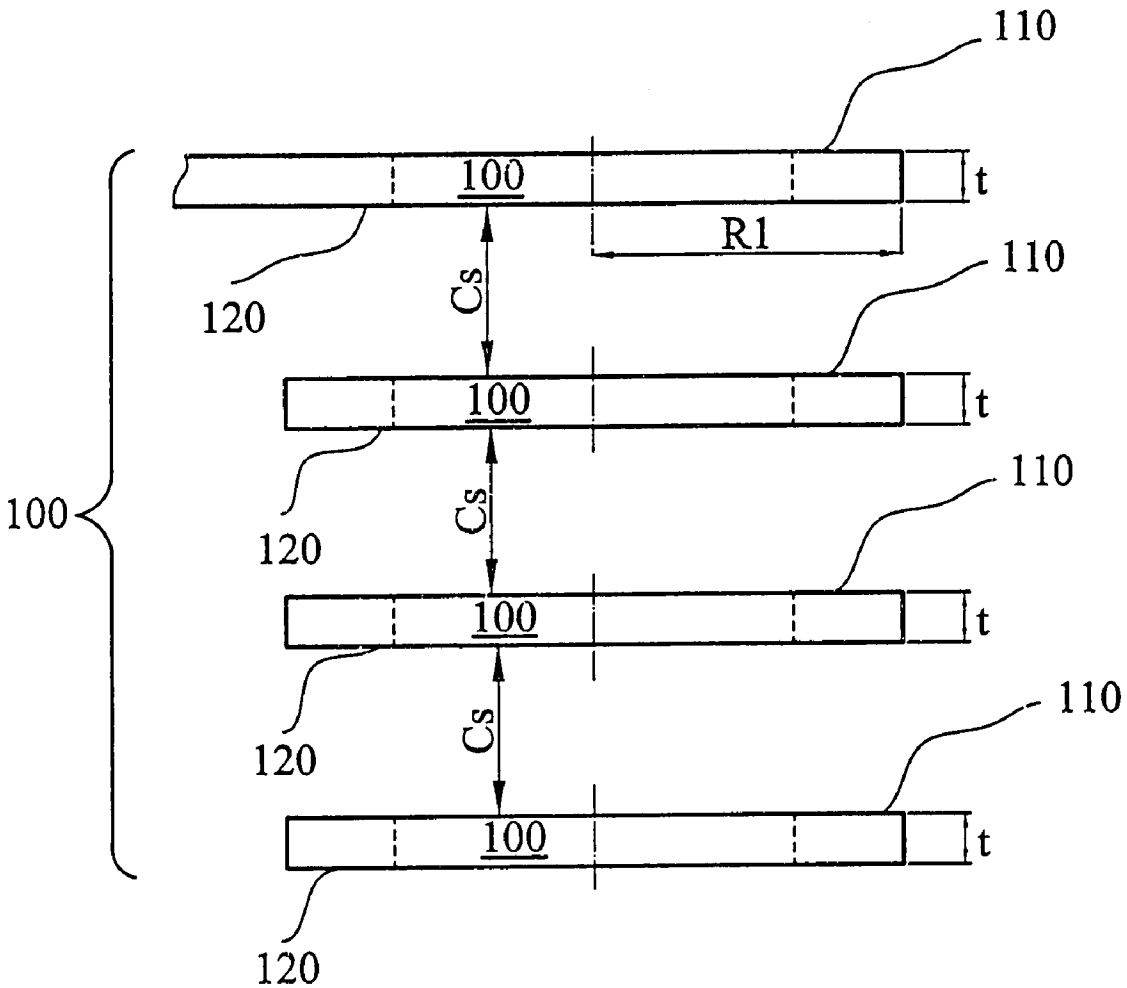

FIG. 2(*a*) is a partial exploded view of the present invention, and FIG. 2(*b*) is a cross-section of the first flat coil 100. The present invention is comprised of a core structure 300 and two flat coils, the first flat coil 100 and the second flat coil 200. The first flat coil 100 is formed by winding a first conductive strip to form a spiral comprising a plurality of circles. The cross-section of the first conductive strip is a rectangle, and the first conductive strip is comprised of a first upper surface 110 and a first lower surface 120, as shown in the cross-section in FIG. 2(*b*). Particularly, the circles each have the same first radius R1 and are arranged layer by layer, such that the first upper surface 110 is substantially parallel and opposite to the first lower surface 120. Furthermore, the first conductive strip is covered with an isolation material, such that the first flat coil 100 is used as an inductor.

The structure of the second flat coil 200 is similar to that of the first flat coil 100. The second flat coil 200 is formed by winding a second conductive strip to form a spiral comprising a plurality of circles. The cross-section of the second conductive strip is a rectangle, and the second conductive strip is comprised of a second upper surface 210 and a second lower surface 220. Particularly, the circles each have the same second radius R2 and are arranged layer by layer, and the second conductive strip is covered with an isolation material or dielectric material (not shown). In this embodiment, the first and second radius, R1 and R2, may or may not equal.

Furthermore, if the thickness of the first conductive strip is t and the number of windings is N, the thickness (or height) of the first flat coil 100 will be approximately tN. Similarly, if the thickness of the second conductive strip is t and the number of windings is N, the thickness (or height) of the second flat coil 200 will be approximately tN. In the figure, the gaps between circles are exaggerated for clearance.

In FIG. 2(*b*), according to theories about plate capacitors, because of the coverage of the isolation or dielectric material, there will be stray capacitance Cs formed between the first upper surface 110 and the first lower surface 120. Thus, two capacitors C can be formed by inserting an electrode board between the two surfaces. In the present invention, the second flat coil 200 is used to provide a plurality of equivalent electrode boards.

Figure 3A:
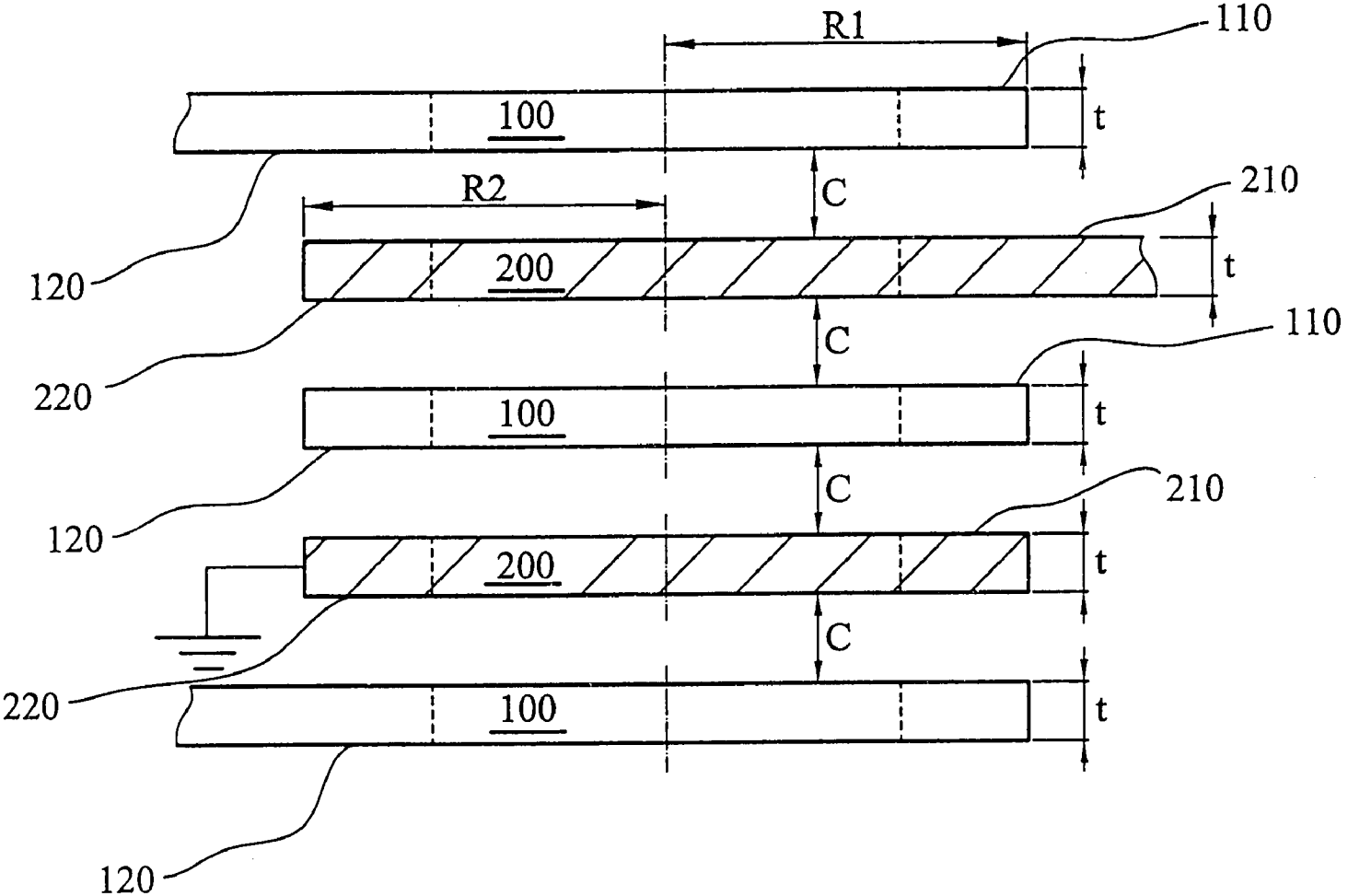
FIG. 3(*a*) shows a schematic cross-section of the low-pass filter according to the present invention.
Figure 3B:
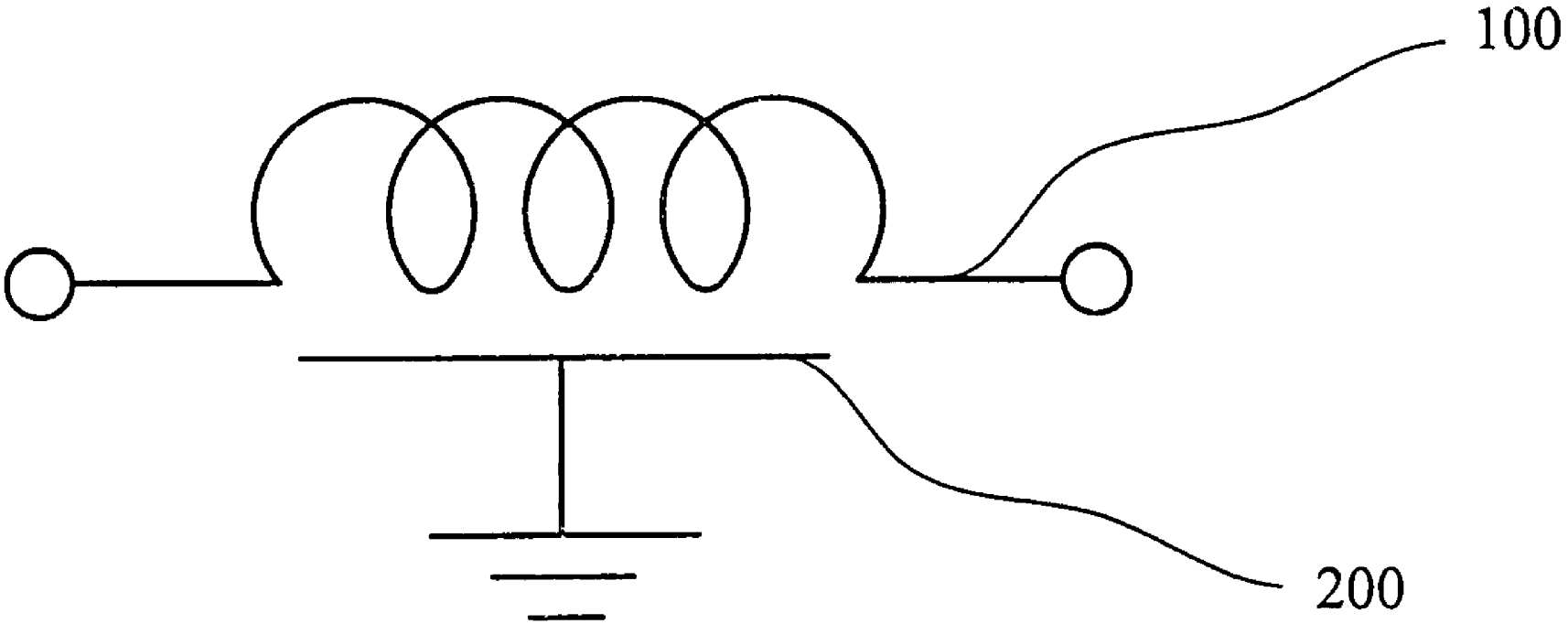
Figure 3C:
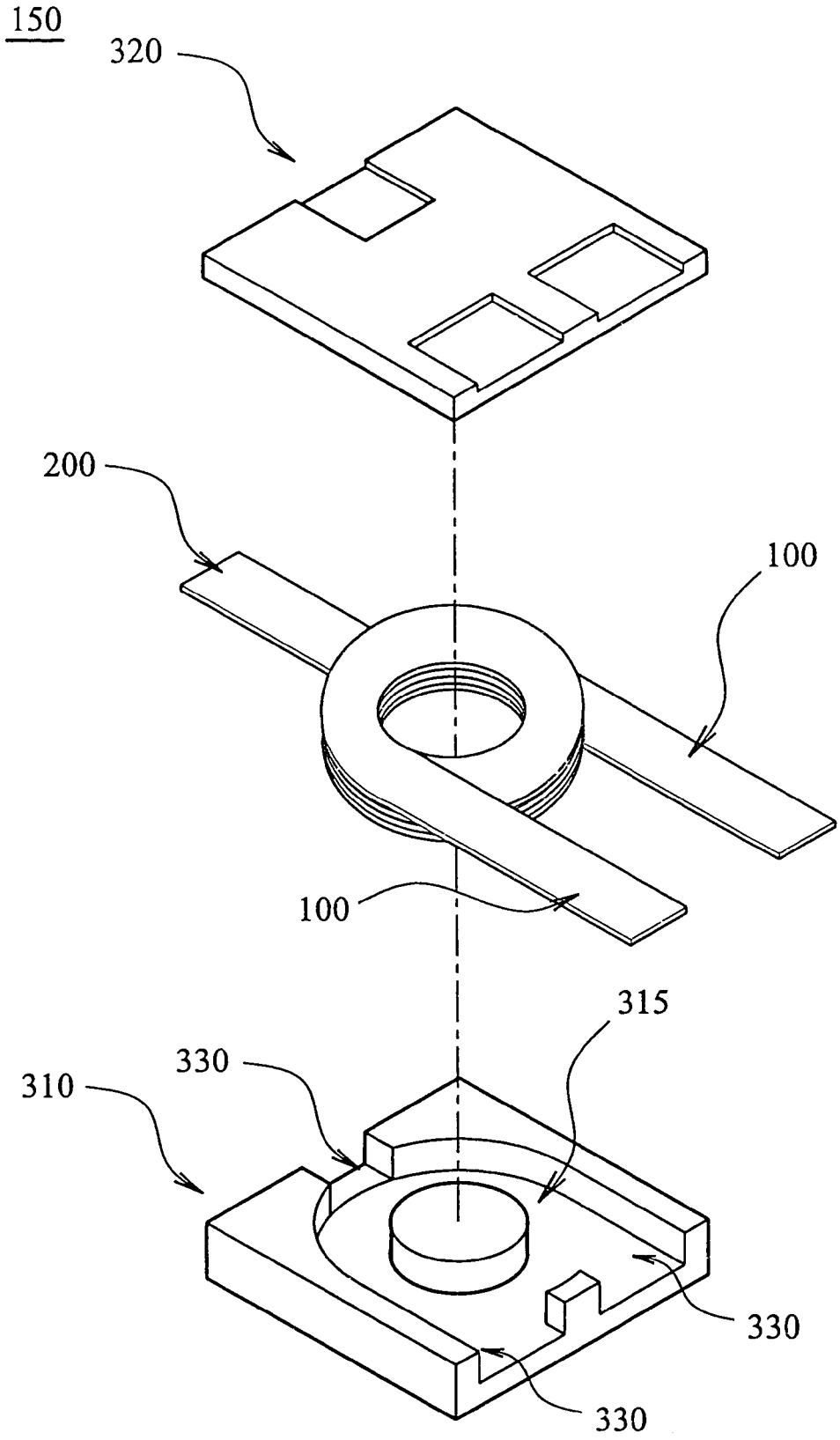

FIG. 3(*a*) shows a schematic diagram illustrating the cross-section of the low-pass filter according to the present invention; FIG. 3(*b*) shows a circuit diagram of the low-pass filter according to the present invention; and FIG. 3(*c*) shows an exploded view of the low-pass filter according to the present invention. As shown in FIG. 3(*a*), each circle of the second flat coil 200 is inserted between opposite sections of the first upper surface 110 and the first lower surface 120, forming a coil assembly 150. The insertion may be processed by winding the second flat coil 200 from one end into the first flat coil 100 along the circles. Thus, the second upper surface 210 is opposite to the first lower surface 120 and the second lower surface 220 is opposite to the first upper surface 110. In operation, the second flat coil 200 is grounded with a terminal, as shown in the circuit diagram in FIG. 3(*a*). Because the shapes of the first and second flat coils 100, 200 are both spirals, interlacingly winding the two flat coils together will effectively composes a low-pass filter according to the present invention.

In FIG. 3(*c*), the coil assembly 150 composed of the first and second flat coils 100, 200 is disposed in a core structure. The core structure, as an example, is comprised of a core base 310 and a core cover 320. Particularly, the core base 310 is shaped as a rectangular box, and is comprised of a bottom, four sidewalls, and a concavity 315 used to contain item. Wherein, one of the sidewalls is provided with three openings 330, via which terminals of the first and second flat coils 100, 200 may extend out from the core base 310. Moreover, by disposing the core cover 320 on the core base 310 containing the coil assembly 150, the fabrication of the low-pass filter of the present invention is completed.

Figure 4:
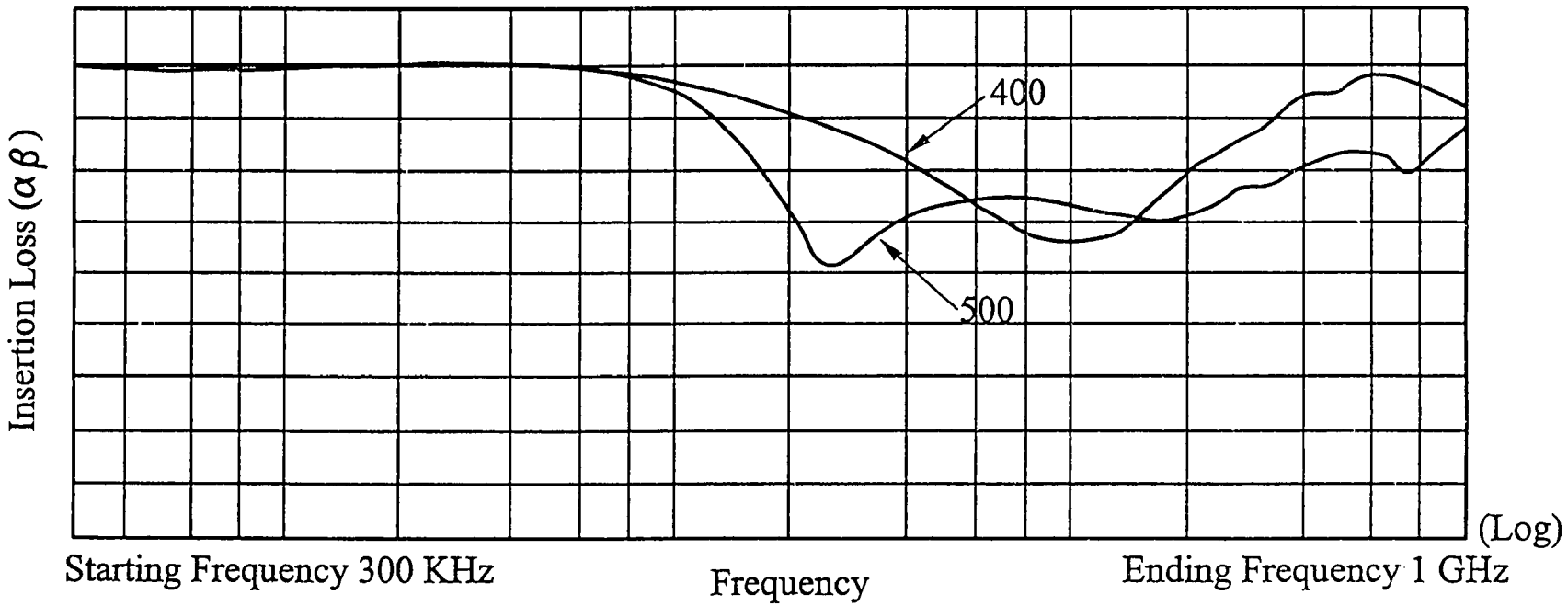
FIG. 4 shows a chart illustrating the relation between frequency of input signal and the insertion loss thereof.

In FIG. 4, the figure shows a comparison of the functional curves, frequency of input signals versus insertion losses, respectively belonging to a low-pass filter (i.e. the low-pass filtering induction device of the present invention) comprising only the first flat coil 100, or comprising both the first and second flat coils 100, 200. Curve 400 shows the character of the first flat coil 100, and curve 500 shows the character of a coil assembly comprising the first and second flat coil 100, 200. It is clear that the low-pass filtering induction device comprising the coil assembly has better performance than that only comprising the first flat coil 100, for the curve 500 has a larger slope implying a larger insertion loss.

Accordingly, in the present invention, stray capacitance is applied to increase the insertion loss so as to improve the filter performance of low-pass filtering induction devices, thereby eliminating the substantial capacitors, such as ceramic capacitors, and greatly reducing the production cost. As well, because of the application of flat coils, the filtering induction device is rather flat and may be formed as a surface-mounted device (SMD). Furthermore, the spirit of the present invention is in the application of stray capacitance formed between conductors, so any specific shape does not limit the cross-section of the coil in the present invention. The coils may have cross-sections of any shape, such as circular.

While the invention has been described with reference to a preferred embodiment, the description is not intended to be construed in a limiting sense. It is therefore contemplated that the appended claims will cover any such modifications or embodiments as may fall within the scope of the invention defined by the following claims and their equivalents.

What is claimed is:

1. A filtering induction device, comprising:

a first coil having a plurality of circles, wherein the first coil is used as an inductor and is covered wit an isolation material;

a second coil having a plurality of circles, wherein the second coil has one terminal grounded and is interlaced with the plurality of circles of the first coil; and a core structure coupled to the first and second coils.

2. The filtering induction device of claim 1, wherein the first coil is a flat coil.

3. The filtering induction device of claim 1, wherein the second coil is a flat coil.

4. The filtering induction device of claim 1, wherein the core structure is further comprised of:

a core base adapted to contain the first and second coils; and a core cover disposed on the core base.

5. The filtering induction device of claim 4, wherein the core base is provided with at least one opening on a sidewall thereof, via which the first and second coils extend out from the core base.

6. A filtering induction device, comprising:

a first coil having a plurality of continued circles, wherein the first coil is used as an inductor and is covered with an isolation material;

a second coil having a plurality of continued circles interlacing with the plurality of circles of the first coil; and a core structure coupled to the first and second coils.

7. The filtering induction device of claim 6, wherein the first coil is a flat coil.

8. The filtering induction device of claim 6, wherein the second coil is a flat coil.

9. The filtering induction device of claim 6, wherein the core structure is further comprised of:

a core base adapted to contain the first and second coils; and a core cover disposed on the core base.

10. The filtering induction device of claim 9, wherein the core base is provided with at least one opening on a sidewall thereof, via which the first and second coils extend out from the core base.

11. The filtering induction device of claim 6, wherein a terminal of the second coil is grounded.

* * * * *